United States Patent [19]

Bando

[11] Patent Number: 4,839,268

[45] Date of Patent: Jun. 13, 1989

[54] SILVER HALIDE COLOR REVERSAL PHOTOSENSITIVE MATERIAL

[75] Inventor: Shinsuki Bando, Kanagawa, Japan

[73] Assignee: Fuji Photo Film Co., Ltd., Kanagawa, Japan

[21] Appl. No.: 136,592

[22] Filed: Dec. 22, 1987

[30] Foreign Application Priority Data

Dec. 22, 1986 [JP] Japan ..... 61-306028

[51] Int. Cl.[4] ..... G03C 1/02; G03C 5/50; G03C 7/30; G03C 7/26

[52] U.S. Cl. ..... 430/567; 430/379; 430/503; 430/505

[58] Field of Search ..... 430/505, 503, 567, 379

[56] References Cited

U.S. PATENT DOCUMENTS

| | | | |
|---|---|---|---|
| 4,434,226 | 2/1984 | Wilgus et al. | 430/569 |
| 4,439,520 | 3/1984 | Kofron et al. | 430/567 |
| 4,656,122 | 4/1987 | Sowinski et al. | 430/567 |
| 4,720,451 | 1/1988 | Shuto et al. | 430/379 |
| 4,748,106 | 5/1988 | Hayashi | 430/567 |
| 4,755,456 | 7/1988 | Sugimoto | 430/567 |

*Primary Examiner*—Mukund J. Shah

*Attorney, Agent, or Firm*—Sughrue, Mion, Zinn, Macpeak & Seas

[57] ABSTRACT

A silver halide color reversal pohotosensitive material is disclosed, comprising a plurality of silver halide emulsion layers on a substrate, wherein 50% or more of the total projected area of silver halide grains contained in at least one of said silver halide emulsion layers is occupied by tabular silver iodobromide grains having an average thickness of 0.5 micron or less, an average diameter of 0.5 micron or more, an average aspect ratio of at least 5/1, and a silver iodide content of 4.0 mol % or less, and said tabular silver iodobromide grains are negative-type silver halide grains forming a latent image mainly inside the grains.

19 Claims, No Drawings

SILVER HALIDE COLOR REVERSAL PHOTOSENSITIVE MATERIAL

FIELD OF THE INVENTION

The present invention relates to a silver halide color reversal photographic material having excellent sharpness and having a high contrast when sensitization development-treated.

BACKGROUND OF THE INVENTION

High image quality, high sensitivity, and treatment stability are demanded for silver halide color photographic materials for photography without distinction as to whether such are negative or reversal materials. As regards the image quality, sharpness, graininess, color reproduction, and the like are important, and as regards the treatment stability, it is important that a color reversal material has a good gradation balance whether it is standard development-treated (whose first development time is to the specification of a reversal article) or sensitization development-treated (whose first development is prolonged and/or temperature is raised).

It has been known that, in a multilayer color photographic material having blue-sensitive, green-sensitive, and red-sensitive silver halide emulsion layers, light scattering caused by silver halide grains in a silver halide emulsion layer is usually apt to lower the sharpness of emulsion layer positioned under the above-mentioned emulsion layer.

Color photographic materials having sharpness, sensitivity, and graininess improved by use of tabular silver halide emulsion grains are mentioned in U.S. Pat. No. 4,439,520. However, use of such a tabular silver halide emulsion causes a severe problem in a reversal treatment of negative type emulsion. A color reversal treatment obtains a color reversal image by black-and-white development (first development)-treating a negative type silver halide emulsion, and, after that, fogging the remaining silver halide and carrying out color development. The black-and-white developing solution contains a solvent for silver halides such as potassium thiocyanate, sodium sulfite, or the like, and it provides a development accelerating effect by a solution physical development. However, if tabular grains having photosensitivity mainly on the surface of grains are used, an apparent increase in sensitivity of color reversal image and a lowering in the maximum density of the same image caused by a solution physical development of non-exposed grains around developed silver formed in the initial period of development using a black-and-white developing solution became marked. As a result, gradation fluctuates widely and contrast is lowered, in particular, when a photosensitive material containing the above-mentioned silver grains is sensitization development-treated.

Tabular silver iodobromide grains having a low silver iodide content of 4.0 mol% or less which are typically used in a color reversal photographic material have a large solubility of grains in the solvent, so that the above-mentioned fluctuation in gradation and lowering in contrast become significant. Therefore, it is very difficult to utilize tabular silver iodobromide grains having such a low silver iodide content in a color reversal photographic material.

SUMMARY OF THE INVENTION

The object of the invention is to provide a silver halide color reversal photographic material having excellent sharpness and also having a high contrast when sensitization development-treated.

The object of the invention has been attained by a silver halide color reversal photosensitive material comprising a plurality of silver halide emulsion layers on a substrate, wherein 50% or more of the total projected area of silver halide grains contained in at least one of said silver halide emulsion layers is occupied by tabular silver iodobromide grains having an average thickness of 0.5 micron or less, an average diameter of 0.5 micron and more, an average aspect ratio of at least 5/1, and a silver iodide content of 4.0 mol% or less, and said silver iodobromide grains are negative type silver halide grains forming a latent image inside the grains.

DETAILED DESCRIPTION OF THE INVENTION

The invention is described in further detail hereinafter.

A color reversal to which the invention is applied usually comprises the following process steps:

First development - washing - reversing bath - color development - compensating bath - bleaching - fixing - washing - stabilizing bath Internal latent image-type tabular silver halide grains disclosed in the present invention are so-called negative type silver halide grains. It is a prerequisite that negative type silver halide grains are subjected to a series of treatment processes such as the above-mentioned color reversal treatment containing a development process to form a negative image, different from direct positive type silver halide grains providing a positive image directly.

Tabular silver halide grains of the invention are internal latent image-type silver halide grains forming a latent image mainly inside the grain, and "negative type silver halide grains forming a latent image mainly inside the grain" in the invention are defined as follows.

A sample is prepared by applying the above-mentioned silver halide emulsion to a cellulose triacetate substrate to obtain a silver coating weight of 2.0 g/m$^2$, and then a wedge exposure of 1/100 sec. under an appropriate illuminance (which is determined by according to a sensitivity of the silver halide with taking into account of the exposure time) with white light of 4800° K. is applied to the sample. Sensitivity obtained when the exposed sample is developed at 25° C. for 5 min. with a developing solution A (surface developing solution) (which sensitivity is usually represented by a reciprocal of an exposure providing a density of fog plus 0.2) is compared with each sensitivity obtained when the exposed sample is developed at 25° C. for 5 min. with each of developing solutions B to E (internal developing solutions) as described below. If the sensitivity when developed with at least one of developing solutions B to E is higher than the sensitivity when developed with the developing solution A, the silver halide emulsion grains are taken as the internal latent image type silver halide grains in accordance with this invention.

| Compound | Developing solutions A to E (pH = 9.6 in all solutions) A | B | C | D | E |
|---|---|---|---|---|---|
| N—methyl-p-amino-phenol sulfate | 2.5 g | 2.5 g | 2.5 g | 2.5 g | 2.5 g |
| Sodium ascorbate | 10.0 g | 10.0 g | 10.0 g | 10.0 g | 10.0 g |
| Potassium metaborate | 35.0 g | 35.0 g | 35.0 g | 35.0 g | 35.0 g |
| Potassium bromide | 1.0 g | 1.0 g | 1.0 g | 1.0 g | 1.0 g |
| Sodium thiosulfate | none | 1.0 g | 2.0 g | 5.0 g | 10.0 g |
| Water to make | 1.0 l | 1.0 l | 1.0 l | 1.0 l | 1.0 l |

The internal latent image type silver halide emulsion of the present invention is designed so that the preliminarily formed latent images inside grains are exposed with a maximum frequency within a given time of the first development in the color reversal development. In other words, since the environs of the surface of silver halides (shell) is dissolved with a reversal processing to expose the formed latent images inside grains, it becomes possible to conduct a development. The timing control is carried out in a preparation process for internal latent image type silver halide grains which is described further below. That is, the timing control is carried out by controlling the amount and precipitation speed of silver halide further precipitated on the surface of tabular silver halide grains providing cores after completion of chemical sensitization of the tabular silver halide grains and by controlling the silver iodide content in the above-mentioned silver halide.

The silver halide color reversal photographic material of the invention has a plurality of silver halide emulsion layers such as a blue-sensitive layer, a green-sensitive layer, and a red-sensitive layer which are different in color sensitivity on a substrate, and further, it usually contains a plurality of silver halide emulsion layers having the same color sensitivity but different in sensitivity. Internal latent image-type tabular silver halide grains prepared by the method of the invention may be used in any one of blue-sensitive, green-sensitive, and red-sensitive emulsion layers, and may also be used in any one of high-sensitivity and low-sensitivity silver halide emulsion layers, and the like, each having the same color sensitivity.

Internal latent image-type tabular silver halide grains in accordance with the present invention may be used without being color sensitization-treated. However, color sensitization of the above-mentioned silver halide grains of the present invention is a preferred embodiment in the invention because internal latent image type silver halide grains have high sensitivity as compared with surface latent image type silver halide grains, as disclosed in Japanese Patent Publication No. 3286/72.

The diameter (average) of internal latent image type silver halide grains of the present invention is generally 5.0 microns or less, and preferably is from 0.5 to 3 microns. The thickness (average) of the same silver halide grains is generally 0.5 micron or less, preferably is from 0.05 to 0.4 micron, and further preferably is from 0.05 to 0.3 microns.

The "average aspect ratio" of the above-mentioned silver halide grains refers to the ratio of the average grain diameter to the average grain thickness. The term "diameter" as applied the silver halide grains in accordance with the present invention means the diameter of a circle having an area the same as the projected area of a grain, and the "thickness" of the grains means the distance between the two parallel surfaces forming a tabular silver halide grain.

The average aspect ratio of the tabular silver halide grains is at least 5/1, and typically it may be from 5/1 to 8/1, or even more, according to practical demands. In an emulsion layer containing the internal latent image-type tabular silver halide grains of the present invention, the above-mentioned silver halide grains possess preferably 50% or more, more preferably 70% or more, and most preferably 90% or more, of the total projected area of silver halide grains in the emulsion.

The internal latent image-type tabular grains of the present invention may be an internal latent image-type tabular silver halide grain having the diameter of grain and/or the thickness of grain each controlled in a monodispersed state, as described in Japanese Patent Publication No. 11386/72.

Tabular silver halide grains "controlled in a monodispersed state" as used herein means grains such that 95% of the grains have a diameter within a range of the number average grain size ±60%, and preferably within the number average grain size ±40%. The "number average grain size" as used herein means a number average diameter based on diameters of projected areas of silver halide grains.

Internal latent image-type tabular silver halide grains in accordance with this invention are silver iodobromide and have a silver iodide content of 4.0 mol% or less.

Internal latent image-type tabular silver iodobromide grains may have uniform distribution of silver iodide in the entire grain or may comprise two or more phases different in a silver iodide content.

For example, tabular silver iodobromide grains having lamellar structure which comprise a plurality of phases different in silver iodide content can also be used in the present invention. Preferred examples of the halogen composition of tabular silver halide grains and of the distribution of halogen in the grains are described in Japanese Patent Application (OPI) Nos. 113927/83, 113928/83, 99433/84, 119344/84, and 119350/84 (the term "OPI" as used herein referred to as "published unexamined Japanese patent application open to public inspection").

As the tabular grain, the grains composed of (111) face, (100) face, or a mixed face of (111) face with (100) face can be selected.

Internal latent image-type tabular silver halide grains prepared in accordance with the present invention have a core prepared by chemically sensitizing tabular silver halide grains prepared by a known process, by an arbitrary combination of sulfur sensitization, gold sensitization, and reduction sensitization, and a shell covering the surface of the core partially or entirely. An average silver content in the shell part is 50% or less, and preferably from 10% to and 30% of the average total silver content of the whole grains. If the silver content in the shell part exceeds 50%, the beginning of development is delayed, and the sensitivity utilizing a usual development time is significantly reduced, so that such a large silver content in the shell is not preferred.

Tabular silver halide grains providing the core of internal latent image-type tabular silver halide grains of the present invention can be prepared by methods known in the art.

For example, the above-mentioned tabular silver halide grains can be obtained by preparing seed crystals in which 40 wt% or more of the tabular grains exist in an environment of a relatively low pBr value of 1.3 or less, and, after that, adding a silver nitrate solution and a halogen solution simultaneously while keeping the pBr value at a nearly the same level to grow the seed crystals.

It is preferred to add a silver nitrate solution and a halogen solution so as to form no new crystalline nuclei in the growth process for grains.

The size of tabular silver halide grains can be regulated by temperature control, by selection of the type and quantity of solvent, and by control of the addition speed of a silver salt and a halide which are used when grains are grown.

By using a solvent for silver halides, as required, in preparing tabular silver halide grains for use in the present invention, the size of the grains, the shape of the grains (for example, the ratio of the diameter to the thickness, and the like), distribution of the grain size, and the growth speed for grains can be controlled. The amount of solvent used is preferably from $10^{-3}$ to 1.0 wt%, especially preferably from 10−2 to 10−1 wt%, based on the weight of reaction solution.

For example, the distribution of grain size can be made more monodispersed and the growth speed of grains can be increased with an increase in an amount of solvent used. On the other hand, there is a tendency of the thickness of grains to increase with an increasing amount of solvent used.

Solvents typically used for silver halides include ammonia, thioethers, thioureas, and the like. As regards thioethers, reference can be made to U.S. Pat. Nos. 3,271,157, 3,790,387, and 3,574,628.

These solvents for silver halides are added to accelerate grain growth when tabular silver halide grains of the present invention are prepared. For accelerating grain growth, a process to increase the addition speed, addition amount, or concentration of a silver salt solution (for example, an aqueous solution of $AgNO_3$) and a halide solution (for example, an aqueous solution of KBr) is preferably used.

Regarding the above-mentioned process, reference may be made, for example, to British Pat. Nos. 1,335,925, U.S. Patent 3,672,900, 3,650,757, and 4,242,445, and Japanese Patent Application (OPI) Nos. 142329/80, 158124/80, 113927/83, 113928/83, 111934/83, and 111936/83 can be referred to.

Tabular silver halide grains providing the core can be chemically sensitized by a known method.

As the chemical sensitization method, gold sensitization methods (for example, described in U.S. Pat. Nos. 2,448,060, and 3,320,069) with a so-called gold compound, sensitization methods (for example, U.S. Pat. Nos. 2,448,060, 2,566,245, and 2,566,263) with a metal such as iridium, platinum, rhodium, palladium, or the like, sulfur sensitization methods (for example, U.S. Pat. Nos. 2,222,264) with a sulfur-containing compound, reduction sensitization methods (for example, described in U.S. Pat. Nos. 2,487,850, 2,518,698, and 2,521,925) with salts, polyamines, or the like, and a combination of two or more methods mentioned above can be used.

The chemical sensitization of the core may be carried out in the course of a series of grain forming process steps, or may be applied to an emulsion prepared by washing formed core grains, and, after that, redispersing the core grains in water.

Formation of the shell is usually carried out by addition of an aqueous solution of a silver salt and an aqueous solution of halogen, as in a single jet process or in a double jet process. Further, it can be also carried out by adding an emulsion containing fine powdered silver halide to perform Ostwald ripening.

The surface of the shell may also be chemically sensitized by mothods as described above.

In a forming stage for cores of tabular silver halide grains usable in the present invention or in a forming stage for shells of the same grains, silver and halide ions can be precipitated on the surface of the tabular grains by controlling the pBr value and temperature in the presence of verious additives, to grow pit-shaped crystal surfaces with a high order Miller index on the surface of the grains and to increase the surface area of the grains. Representative examples of additives used for forming the crystal surface with a high order Miller index include additives to form pits composed of (211) face includes, for example, compounds (I) to (VI). Additives to form pits composed of (331) face includes, for example, compounds (VII) to (X). It is also possible to grow crystal surfaces with a high order Miller index composed of (100) face, (110) face, (210) face, or (321) face by selecting other additives.

Compound examples (I)

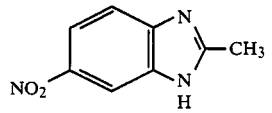

(II)

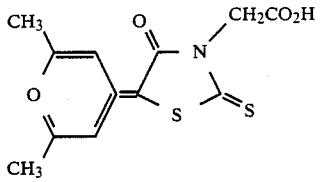

(III)

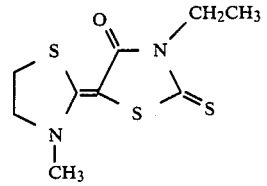

(IV)

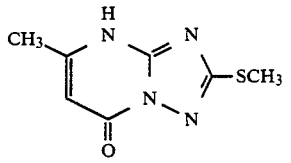

(V)

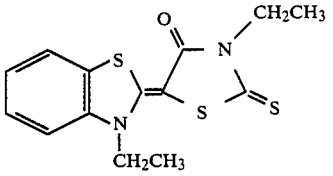

(VI)

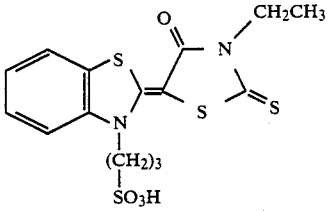

-continued

Compound examples (VII)

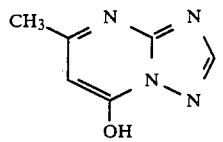

(VIII)

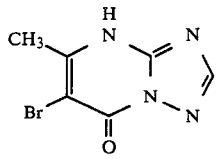

(IX)

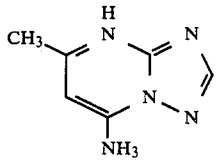

(X)

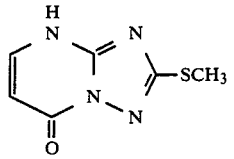

The thickness of layer containing internal latent image-type tabular silver halide grains of the present invention is preferably from 0.3 to 6.0 microns, and especially preferably from 0.5 to 4.0 microns.

Hitherto, it has been necessary to increase the coating thickness of an emulsion layer containing grains of large grain diameter to avoid a phenomenon of emulsion grains themselves protruding from the coating layer. However, if tabular grains are used, the thickness of the coating layer can be made reduced and sharpness of photosensitive material can be improved, because the total thickness of tabular grains can be reduced substantially thereby.

Further, a coating weight of tabular silver halide grains is preferably from 0.1 to 6 g/m$^2$, and especially preferably from 0.3 to 3 g/m$^2$.

Next, other silver halide grains usable in the present invention are described.

Other silver halide grains usable in the present invention may be so-called regular grains having a regular crystalline form such as cubic, octahedral, or tetradecahedral, grains having an irregular crystalline form such as spherical, grains having a crystalline defect such as a twining plane or the like, or grains having a composite form of these crystalline forms. Further, a mixture of the above-mentioned various types of grains can be used in the present invention.

Other silver halide grains usable in the present invention may be surface latent image type grains forming a latent image on the surface, internal latent image type grains forming a latent image inside the grain, which are disclosed, for example, in U.S. Pat. No. 3,206,313, or grains forming a latent image both on the surface and in the inside, which are disclosed, for example, in U.S. Pat. No. 3,317,322.

Photographic emulsions of silver halides which can be used in the present invention other than the silver halide of the present invention can be prepared by using processes mentioned, for example, in *Research Disclosure*, RD No. 17643 (Dec. 1978), pages 22 to 23, "I. Emulsion Preparation and Types"; in *Research Disclosure*, RD No. 18716 (Nov. 1979), page 648; in P. Glafkides, *Chimie et Physique Photographique*, (Paul Montel, 1967); in Duffin, *Photographic Emulsion Chemistry*, (Focal Press, 1966); and in V. L. Zelikman et al, *Making and Coating Photographic Emulsion*, (Focal Press, 1964). Monodispersed emulsions as mentioned in U.S. Pat. Nos. 3,574,628 and 3,655,394 and British Pat. No. 1,413,748 are also preferred.

Silver halide grains usable in the present invention may be grains having uniform crystalline structure, grains having halogen compositions different between the inside and the outside, or grains having lamellar structure, and further, they may be grains in which silver halides different in a composition are joined by epitaxial junction, or may be grains in which a silver halide is joined with a compound other than silver halides, for example, silver rhodanate, lead oxide, or the like.

Further, a mixture of grains having various crystalline forms may be used.

Silver halide emulsions after being physically ripened, chemically ripened, and spectrally sensitized are usually used. Additives used in such processes are mentioned in *Research Disclosure*, RD No. 17643 and in *Research Disclosure*, RD No. 18716, and disclosure relevant to the additives is noted in the table shown below.

Known photographic additives usable in the present invention are also described in the above-cited literature and places in which the additives are mentioned have been also shown in the table.

| Additives, types | RD 17643 | RD 18716 |
|---|---|---|
| 1. Chemical Sensitizer | Page 23 | Page 648, right column |
| 2. Sensitivity increasing agent | | Page 648, right column |
| 3. Spectral Sensitizer and Supersensitizer | Pages 23 to 24 | Page 648 right column to page 649 right column |
| 4. Whitening Agent | Page 24 | |
| 5. Antifoggant and Stabilizer | Pages 24 to 25 | Page 649 right column |
| 6. Light-absober, Filter dye and Ultraviolet absorber | Pages 25 to 26 | Page 649 right column to page 650 left column |
| 7. Stain inhibitor | Page 25 right column | Page 650 left column to right column |
| 8. Color image stabilizer | Page 25 | |
| 9. Hardening agent | Page 26 | Page 651 left column |
| 10. Binder | Page 26 | Page 651 left column |
| 11. Plasticizer and Lubricant | Page 27 | Page 650 right column |
| 12. Coating assistant and Surface active agent | Pages 26 to 27 | Page 650 right column |
| 13. Antistatic agent | Page 27 | Page 650 right column |

Various photographic coupler can be used in the present invention, as described below.

Various color forming couplers can be used in the present invention, and specific examples of color forming couplers are described in patents as described in above-noted *Research Disclosure*, RD No. 17643, VII-C-G.

As an yellow dye forming coupler (hereinafter, more simply referred to as a yellow coupler, etc.), yellow couplers described, for example, in U.S. Pat. Nos. 3,933,501, 4,022,620, 4,326,024, and 4,401,752, Japanese Patent Publication No. 10739/83, and British Pat. Nos. 1,425,020, and 1,476,760 are preferred.

As a magenta a coupler, 5-pyrazolone type compounds and pyrazoloazole type compounds are preferred, and compounds as described in U.S. Pat. Nos. 4,310,619 and 4,351,897, European Pat. No. 73,636, U.S. Pat. Nos. 3,061,432 and 3,725,067, *Research Disclosure*, RD No. 24220 (June, 1984), Japanese Patent Application (OPI) No. 33552/85, *Research Disclosure*, RD No. 24230 (June, 1984), Japanese Patent Application (OPI) No. 43659/85, and U.S. Pat. Nos. 4,500,630 and 4,540,654 are especially preferred.

As a cyan coupler, phenol type and naphthol type couplers are noted, and such couplers are described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) 3,329,729, European Pat. No. 121,365A, U.S. Pat. Nos. 3,446,622, 4,333,999, 4,451,559, and 4,427,767, and European Pat. No. 161,626A are preferred.

As a colored coupler (i.e., a coupler having color before dye formation) to compensate the unnecessary adsorption of colored dye, couplers as described in above-noted *Research Disclosure*, RD No. 17643, item VII-G, U.S. Pat. No. 4,163,670, Japanese Patent Publication No. 39413/82, U.S. Pat. Nos. 4,004,929, and 4,138,258, and British Pat. No. 1,146,368 are preferred.

As useful couplers whose colored dyes have moderate diffusibility, those described in U.S. Pat. No. 4,366,237, British Pat. No. 2,125,570, European Pat. No. 96,570, and West German Patent Application (OLS) No. 3,234,533 are preferred.

Typical examples of dye forming coupler having polymer structure are mentioned in U.S. Pat. Nos. 3,451,820, 4,080,211, and 4,367,282, and British Pat. No. 2,102,173.

Couplers which release a photographically useful residual group with the coupling reaction can also be used preferably in the present invention. As a DIR (development inhibitor releasing) coupler releasing a development inhibitor, those described in patents cited in above cited *Research Disclosure*, RD No. 17643, item VII-F, Japanese Patent Application (OPI) Nos. 151944/82, 154234/82, and 184248/85, and U.S. Pat. No. 4,248,962 are preferred.

As a coupler which releases a nucleating agent or a development accelerator in an imagewise form in a development process, those described in British Pat. Nos. 2,097,140, and 2,131,188, and Japanese Patent Application (OPI) Nos. 157638/84 and 170840/84 are preferred.

Other couplers usable in the photosensitive material of the present invention include competing couplers as described in U.S. Pat. No. 4,130,427, multiequivalent couplers as described in U.S. Pat. Nos. 4,283,472, 4,338,393, and 4,310,618, couplers releasing a DIR redox compound which are mentioned in Japanese Patent Application (OPI) No. 185950/85, and couplers releasing a dye coloring after being released which are mentioned in European Pat. No. 173,302A.

Couplers for use in the present invention can be introduced into a photosensitive material by various known dispersing methods. Examples of high boiling point organic solvents which are used in oil-in-water type dispersing methods are in U.S. Pat. No. 2,322,027.

The process and effect of latex dispersing method and specific examples of latex for impregnation are mentioned in U.S. Pat. No. 4,199,363, and West German Patent Application (OLS) Nos. 2,541,274 and 2,541,230.

Suitable substrates usable in the present invention are described, for example, in above noted *Research Disclosure* RD No. 17643, Page 28, and *Research Disclosure*, RD No. 18716, page 647 right column to page 648 left column.

Color photographic materials prepared by the method of the present invention can be development-treated by conventional developing processes noted in above-noted *Research Disclosure*, RD No. 17643, pages 28 to 29, and above-noted *Research Disclosure*, RD No. 18716, page 651 left column to right column.

Color photographic materials of the present invention are usually developed and bleach-fixed or fixed before being washed or stabilized.

In the washing process, in general, two or more tanks are used and countercurrent washing is adopted to save water. As the representative example of stabilization treatment, it is mentioned to carry out a multi-stage countercurrent stabilization treatment instead of washing process, as in a process mentioned in Japanese Patent Application (OPI) No. 8543/82.

The present invention is described in more detail in the examples hereinafter. However, it is not limited to these examples.

EXAMPLE 1

Aqueous solutions I to VI as shown in Table 1 were prepared.

TABLE 1

| Aqueous solution | Composition of aqueous solution |
|---|---|
| Solution I | Aqueous solution containing 30 g of inactive gelatin and 0.07 g of KBr in 1 l of solution. |
| Solution II | Aqueous solution containing 30 g of inactive gelatin and 11 g of KBr in 1 l of solution. |
| Solution III | Aqueous solution containing 170 g of $AgNO_3$ in 1 l of solution. |
| Solution IV | Aqueous solution containing 116.2 g of KBr and 4.1 g of KI in 1 l of solution. |

Emulsions A to F were prepared as follows.

Emulsion A (Surface Latent Image-Type Non-Tabular Silver Halide Emulsion)

As shown in Table 2, Solution III and Solution IV were added to solution I by a double jet method keeping pAg at 7.1 in the first stage and in the second stage. After completion of the addition, the resulting emulsion was desalted by a known process, and, after that, 2.5 mg of $Na_2S_2O_3$ and 1 mg of $KAuCl_4$ were added to the emulsion to chemically sensitize it at 70° C. for 50 min.

Emulsion B (Surface Latent Image-Type Non-Tabular Silver Halide Emulsion)

Silver halide grains were formed as in the grain formation process of Emulsion A, except that the temperature of the reaction vessel was lowered and the addition speed of solution in the first stage and in the second stage was increased as compared with the process of Emulsion A. The details are shown in Table 2. After completion of the addition, the resulting emulsion was desalted, as in Emulsion A, and after that, 7.5 mg of $Na_2S_2O_3$ and 3 mg of $KAuCl_4$ were added to the emulsion to chemically sensitize it at 70° C. for 50 min.

Emulsion C (Surface Latent Image-Type Tabular Silver Halide Emulsion)

As shown in Table 2, Solution III and Solution IV were added to Solution II by a double jet process in the first stage and in the second stage. After completion of the addition, the resulting emulsion was desalted, as in Emulsion A, and, after that, 4 mg of $Na_2S_2O_3$ and 2 mg of $KAuCl_4$ were added to the emulsion to chemically sensitize it at 70° C. for 50 min.

Emulsion D (Surface Latent Image-Type Tabular Silver Halide Emulsion)

Silver halide grains were formed as in the grain formation process of Emulsion C, except that the temperature of the reaction vessel was lowered and the addition speed of solution in the first stage and in the second stage was increased as compared with the process of Emulsion C. The details are shown in Table 2. After completion of the addition, the resulting emulsion was desalted, as in Emulsion A, and, after that, 12 mg of $Na_2S_2O_3$ and 6 mg of $KAuCl_4$ were added to the emulsion to chemically sensitize it at 70° C. for 50 min.

Emulsion E (Internal Latent Image-Type Tabular Silver Halide Emulsion)

As shown in Table 2, Solution III and Solution IV were added to Solution II by a double jet process in the first stage and in the second stage. After completion of the addition, 3 mg of $Na_2S_2O_3$ and 1.8 mg of $KAuCl_4$ were added to the resulting emulsion and it was chemically sensitized at 70° C. for 50 min. Further, as shown in Table 2, Solution III and Solution IV were added to the core emulsion by a double jet process in the third stage to form a shell on the core grain. After completion of the addition, the resulting emulsion was desalted, as in Emulsion A.

Emulsion F (Internal Latent Image-Type Tabular Silver Halide Emulsion)

Core grains were formed as in the preparation process for core grains of Emulsion E, except that the temperature of the reaction vessel was lowered and the addition speed of solutions in the first stage and in the second stage was increased as compared with the process of Emulsion E. The details are shown in Table 2. After completion of the addition, 9 mg of $Na_2S_2O_3$ and 5.4 mg of $KAuCl_4$ were added to the resulting emulsion, and it was chemically sensitized at 70° C. for 50 min. After that, as shown in Table 2, Solution III and Solution IV were added to the core emulsion by a double jet process in the third stage to form a shell on the core grain. After completion of the addition, the resulting emulsion was desalted as in Emulsion A.

Emulsions A and B were monodispersed silver iodobromide generally having a crystal habit of the cube, and Emulsions C to F each were a tabular silver iodobromide emulsion in which 50% or more of the total projected area of all grains was processed by grains having an average aspect ratio of at least 5/1. Silver iodide contents in the silver iodobromide grains contained in Emulsions A to F were all 2.5 mol%. Average grain sizes of grains contained in Emulsions A to F were shown in Table 3.

TABLE 2

| Emulsion designation | Temperature (°C.) | 1st stage Solution III (cc) | 1st stage Solution IV (cc) | 1st stage Addition time | 2nd stage Solution III (cc) | 2nd stage Solution IV (cc) | 2nd stage Addition time (min) | 3rd stage Solution III (cc) | 3rd stage Solution IV (cc) | 3rd stage Addition time (min) |
|---|---|---|---|---|---|---|---|---|---|---|
| A | 80 | 294 | 294 | 70 min | 288 | 288 | 40 | | | |
| B | 60 | " | " | " | " | " | " | | | |
| C | 65 | 30 | 30.5 | 30 sec | 558 | 560 | 60 | | | |
| D | 40 | " | " | 10 sec | " | " | 40 | | | |
| E | 65 | " | " | 30 sec | 500 | 501 | 51 | 58 | 59 | 9 |
| F | 40 | " | " | 10 sec | " | " | 34 | " | " | 6 |

TABLE 3

| Emulsion designation | Average grain size* (μm) |
|---|---|
| A | 0.65 |
| B | 0.40 |
| C | 1.10 |
| C | 0.60 |
| E | 1.10 |
| F | 0.60 |

*The diameter of circle having the same area as the projected area of individual grains was determined. An average value of thus obtained diameters was calculated.

Coating samples were prepared by applying each of Emulsions A to F to a substrate to obtain a silver coating weight of 2.0 g/m². Each sample was wedge-exposed with white light, and the exposed sample was developed with each of Developing Solutions A and C at 25° C. for 5 min. The thus obtained images were tested for sensitometry and the relative sensitivity of image obtained with Developing Solution C to an image obtained with Developing Solution A was determined. The results were shown in Table 4.

From the results in Table 4, it is found that Emulsions A to D are all surface latent image-type emulsions which have high sensitivity when developed with Developing Solution A as compared with that when developed with Developing Solution C. Further, it is found that Emulsions E and F are internal latent image-type emulsions which have high sensitivity when developed with Developing Solution C as compared with that when developed with Developing Solution A.

| | Developing solution A (pH = 9.6) | Developing solution C (pH = 9.6) |
|---|---|---|
| N—methyl-p-aminophenol sulfate | 2.5 g | 2.5 g |
| Sodium ascorbate | 10.0 g | 10.0 g |
| Potassium metaborate | 35.0 g | 35.0 g |
| Potassium bromide | 1.0 g | 1.0 g |
| Sodium thiosulfate.$5H_2O$ | — | 2.0 g |
| Water to make | 1.0 l | 1.0 l |

TABLE 4

| Emulsion | Relative sensitivity of the sensitivity in the case of an image obtained by development with Developing Solution C to the sensitivity in the case of an image obtained by development with Developing Solution A** |
|---|---|
| A | 50 |
| B | 40 |
| C | 40 |
| D | 30 |
| E | 200 |
| F | 180 |

**Sensitivity was determined as a reciprocal of the exposure necessary to provide a density of fog plus 0.1.

Multilayer color reversal photographic materials 101 to 103 were prepared by disposing layers each having such a composition as shown below on a cellulose triacetate substrate in proper order. In blue-sensitive layers of samples 101 to 103, Emulsions A to F were used as shown in Table 5 to compare the emulsions. (In red-sensitive layers and in green-sensitive layers, Emulsions A and B were used commonly.) Herein, Samples 101 and 102 were comparative examples and Sample 103 was an example of the present invention. In Example 1, internal latent image-type tabular silver iodobromide grains of the present invention were used without being color sensitized.

TABLE 5

| Sample name | 3rd layer | 4th layer | 6th layer | 7th layer | 10th layer | 11th layer |
|---|---|---|---|---|---|---|
| 101 (Comparison) | B | A | B | A | B | A |
| 102 (Comparison) | B | A | B | A | D | C |
| 103 (Invention) | B | A | B | A | F | E |

The 1st layer: Antihalation layer

Gelatin layer (dry film thickness: 2 μm) containing the following:

| | |
|---|---|
| Black colloidal silver | 0.25 g/m$^2$ |
| Ultraviolet absorber U-1 | 0.04 g/m$^2$ |
| Ultraviolet absorber U-2 | 0.1 g/m$^2$ |
| Ultraviolet absorber U-3 | 0.1 g/m$^2$ |
| High boiling point organic solvent $\overline{O}$-1 | 0.1 cc/m$^2$ |

The 2nd layer: Intermediate layer

Gelatin layer (dry film thickness: 1 μm) containing the following:

| | |
|---|---|
| Compound H-1 | 0.05 g/m$^2$ |
| High boiling point organic solvent $\overline{O}$-2 | 0.05 cc/m$^2$ |

The 3rd layer: The 1st red-sensitive emulsion layer

Gelatin layer (dry film thickness: 1 μm) containing the following:

| | |
|---|---|
| Silver iodobromide emulsion as in Table 5 spectrally sensitized with Sensitizing dye S-1 and Sensitizing dye S-2 | 0.5 g/m$^2$ (as silver) |
| Coupler C-1 | 0.25 g/m$^2$ |
| High boiling point organic solvent $\overline{O}$-2 | 0.12 cc/m$^2$ |

The 4th layer: The 2nd red-sensitive emulsion layer

Gelatin layer (dry film thickness: 2.5 μm) containing the following:

| | |
|---|---|
| Silver iodobromide emulsion as in Table 5 spectrally sensitized with Sensitizing dye S-1 and Sensitizing dye S-2 | 0.8 g/m$^2$ (as silver) |
| Coupler C-2 | 0.69 g/m$^2$ |
| High boiling point organic solvent $\overline{O}$-2 | 0.33 cc/m$^2$ |

The 5th layer: Intermediate layer

Gelatin layer (dry film thickness: 1 μm) containing the following:

| | |
|---|---|
| Compound H-1 | 0.1 g/m$^2$ |
| High boiling point organic solvent $\overline{O}$-2 | 0.1 cc/m$^2$ |

The 6th layer: The 1st green-sensitive emulsion layer

Gelatin layer (dry film thickness: 1 μm) containing the following:

| | |
|---|---|
| Silver iodobromide emulsion as in Table 5 spectrally sensitized with Sensitizing dye S-3 and Sensitizing dye S-4 | 0.7 g/m$^2$ (as silver) |
| Coupler C-2 | 0.35 g/m$^2$ |
| High boiling point organic solvent $\overline{O}$-2 | 0.26 cc/m$^2$ |

The 7th layer: The 2nd green-sensitive emulsion layer

Gelatin layer (dry film thickness: 2.5 μm) containing the following:

| | |
|---|---|
| Silver iodobromide emulsion as in Table 5 spectrally sensitized with Sensitizing dye S-3 and Sensitizing dye S-4 | 0.7 g/m$^2$ (as silver) |
| Coupler C-3 | 0.25 g/m$^2$ |
| High boiling point organic solvent $\overline{O}$-2 | 0.05 cc/m$^2$ |

The 8th layer: Intermediate layer

Gelatin layer (dry film thickness: 1 μm) containing the following:

| | |
|---|---|
| Compound H-1 | 0.058 g/m$^2$ |
| High boiling point organic solvent $\overline{O}$-2 | 0.1 g/m$^2$ |

The 9th layer: Yellow filter layer

Gelatin layer (dry film thickness: 1 μm) containing the following:

| | |
|---|---|
| Yellow colloidal silver | 0.1 g/m$^2$ |
| Compound H-1 | 0.03 g/m$^2$ |
| Compound H-2 | 0.03 g/m$^2$ |
| High boiling point organic solvent $\overline{O}$-2 | 0.04 cc/m$^2$ |

The 10th layer: The 1st blue-sensitive emulsion layer

Gelatin layer (dry film thickness: 1.5 μm) containing the following:

| | |
|---|---|
| Silver iodobromide emulsion as in Table 5 | 0.6 g/m$^2$ (as silver) |
| Coupler C-4 | 0.5 g/m$^2$ |
| High boiling point organic solvent $\overline{O}$-2 | 0.1 cc/m$^2$ |

The 11th layer: The 2nd blue-sensitive emulsion layer

Gelatin layer (dry film thickness: 3 μm) containing the following:

| | |
|---|---|
| Silver iodobromide emulsion as in Table 5 | 1.1 g/m$^2$ (as silver) |
| Coupler C-5 | 1.2 g/m$^2$ |
| High boiling point organic solvent $\overline{O}$-2 | 0.23 cc/m$^2$ |

The 12th layer: The 1st protective layer

Gelatin layer (dry film thickness: 2 μm) containing the following:

| | |
|---|---|
| Ultraviolet absorber U-1 | 0.02 g/m$^2$ |
| Ultraviolet absorber U-2 | 0.03 g/m$^2$ |
| Ultraviolet absorber U-3 | 0.03 g/m$^2$ |
| Ultraviolet absorber U-4 | 0.29 g/m$^2$ |
| High boiling point organic solvent $\overline{O}$-2 | 0.28 cc/m$^2$ |

The 13th layer: The 2nd protective layer

Gelatin layer (dry film thickness: 0.8 μm) containing the following:

| | |
|---|---|
| Fine powdered silver iodobromide emulsion fogged on the surface (iodide content: 1 mol %, average grain size: 0.06 μm) | 0.1 g/m$^2$ (as silver) |
| Polymethyl methacrylate particles (average particle size: 1.5 μm) | 0.1 g/m$^2$ |

To each layer, in addition to the above-mentioned composition, Gelatin hardening agent H-3 and a Surface active agent were added.

The compounds used to prepare the samples are shown hereinafter.

C-1

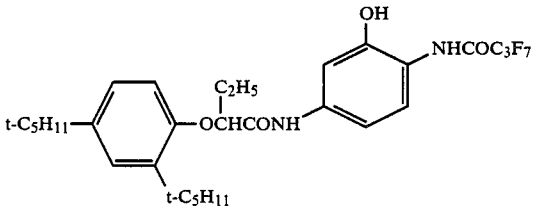

C-2

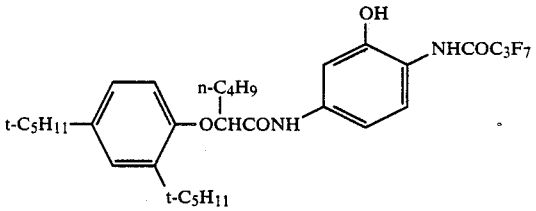

-continued

C-3

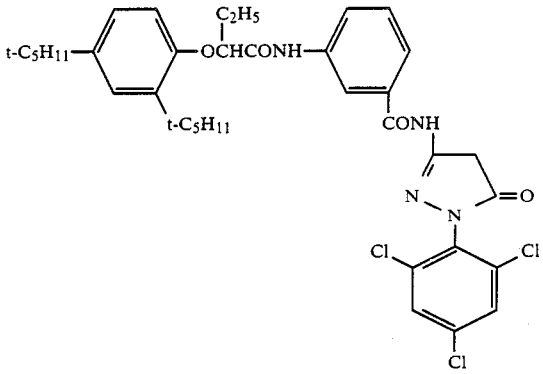

C-4

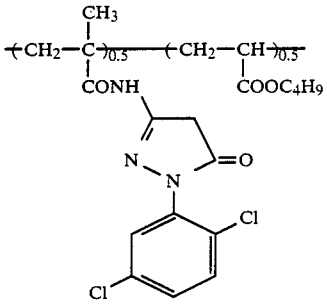

C-5

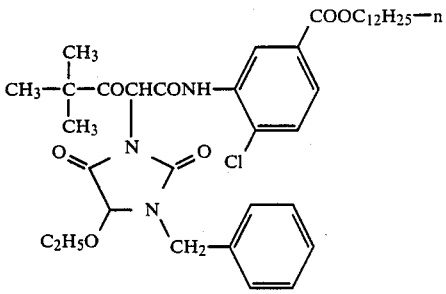

U-1

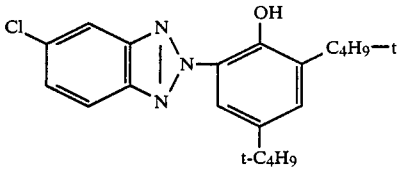

U-2

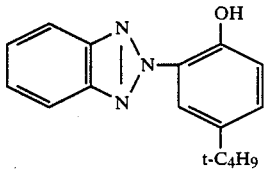

U-3

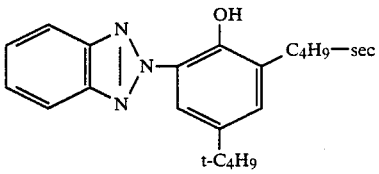

-continued

U-4

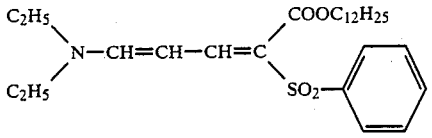

H-1

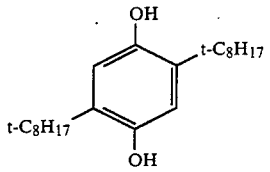

H-2

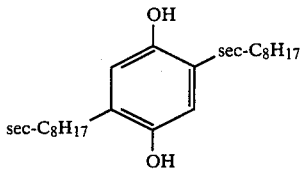

H-3

$CH_2{=}CHSO_2CH_2CONHCH_2$
$CH_2{=}CHSO_2CH_2CONHCH_2$ $\bar{O}$-1

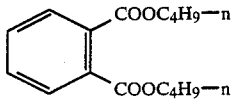

$\bar{O}$-2

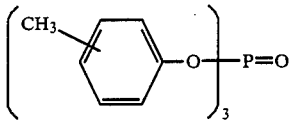

S-1

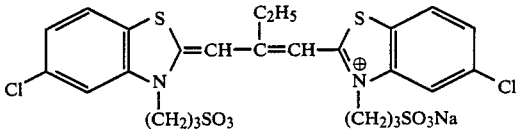

S-2

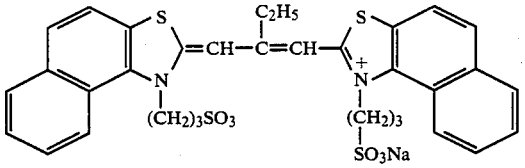

S-3

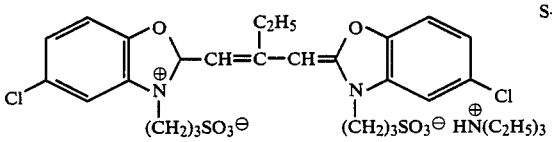

S-4

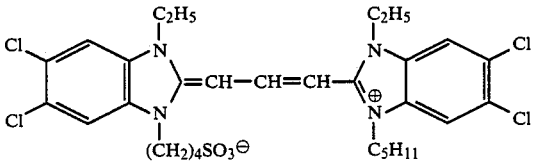

Samples prepared by wedge-exposing Samples 101 to 103 with a light source of 4800° K. and Samples prepared by exposing Samples 101 to 103 through a pattern for measurement of MTF (modulation transfer frequency) with the same light source were each treated as follows.

The treating processes and treating solutions used were as follows:

| Process | Time | Temperature |
|---|---|---|
| 1st development | 6 min | 38° C. |
| Washing | 2 min | " |
| Reversal | 2 min | " |
| Color development | 6 min | " |
| Compensation | 2 min | " |
| Bleach | 6 min | " |
| Fixing | 4 min | " |
| Washing | 4 min | " |
| Stabilization | 1 min | Room temperature |
| Drying | | |

Compositions of treating solutions used were as follows:

| | |
|---|---|
| The 1st developing solution | |
| Water | 700 ml |
| Sodium tetrapolyphosphate | 2 g |
| Sodium sulfite | 20 g |
| Hydroquinone.monosulfonate | 30 g |
| Sodium carbonate (monohydrate) | 30 g |
| 1-phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1 l |
| pH | 10.1 |
| Reversing solution | |
| Water | 700 ml |
| Nitro-N,N,N—trimethyleneosukin acid 6 Na salt | 3 g |
| Stannous chloride (dihydrate) | 1 g |
| p-aminophenol | 0.1 g |
| Sodium hydroxide | 8 g |
| Glacial acetic acid | 15 ml |
| Water to make | 1 l |
| Color developing solution | |
| Water | 700 ml |
| Sodium tetrapolyphosphate | 2 g |
| Sodium sulfite | 7 g |
| Sodium triphosphate (12 hydrate) | 36 g |
| Potassium bromide | 1 g |
| Potassium iodide (0.1% solution) | 90 ml |
| Sodium hydroxide | 3 g |
| N—ethyl-N—(β-methanesulfonamidoethyl)-3-methyl-1-aminoaniline.sulfate | 11 g |
| Ethylenediamine | 3 g |
| Water to make | 1 l |
| Compensating solution | |
| Water | 700 ml |
| Sodium sulfite | 12 mg |
| Sodium ethylenediaminetetraacetate (dihydrate) | 8 g |
| Thioglycerine | 0.4 ml |
| Glacial acetic acid | 3 ml |
| Water to make | 1 l |
| Bleaching solution | |
| Water | 800 ml |
| Sodium ethylenediaminetetraacetate (dihydrate) | 2.0 g |
| Ammonium ethylenediaminetetraacetato ferrate (dihydrate) | 120.0 g |
| Potassium bromide | 100.0 g |
| Water to make | 1 l |
| Fixing solution | |
| Water | 800 ml |
| Ammonium thiosulfate | 80.0 g |
| Sodium sulfite | 5.0 g |
| Sodium hydrogensulfite | 5.0 g |
| Water to make | 1000 ml |
| Stabilizing solution | |

-continued

| | |
|---|---|
| Water | 800 ml |
| Formalin (37 wt % formaldehyde) | 5.0 ml |
| Fuji Driwel (produced by Fuji Photo Film Co., Ltd.) | 5.0 ml |
| Water to make | 1000 ml |

Further, samples prepared by wedge-exposing Samples 101 to 103 with a light source of 4800° K. were sensitization-treated by extending the development time of the first development to 8 min.

Cyan images, magenta images, and yellow images formed in the wedge-exposed samples after the above-mentioned treatment were all tested for a usual sensitometry, and those images formed in the samples exposed through a pattern for MTF measurement after the above-mentioned treatment were all measured with a micro densitometer to determine the MTF value. In Table 6, the relative sensitivity and the gamma representing contrast of yellow image and the density of the unexposed part at each developing time are shown and in Table 7, the MTF value of each image at a frequency of 30 cycles/mm is shown.

As shown in Table 6 and in Table 7, Sample 102 using tabular silver halides of Emulsion C and of Emulsion D showed high MTF values as compared with that of Sample 101 using non-tabular silver halide emulsions, but showed a marked lowering of contrast of yellow image when sensitization development-treated. On the other hand, Sample 103 using internal latent image-type tabular silver halide emulsions prepared according to the method of the present invention has the same degree of sharpness as Sample 102 using surface latent image-type tabular silver halide emulsions has and has a higher contrast when sensitization development-treated than the Sample 102 has when development-treated in the same manner.

TABLE 6

| Sample | Developing time of 1st development (min.) | Relative* sensitivity | Density of unexposed part | Gamma** |
|---|---|---|---|---|
| 101 | 6 | 100 | 3.50 | 1.50 |
| (Comparison) | 8 | 200 | 3.10 | 1.60 |
| 102 | 6 | 100 | 3.50 | 1.50 |
| (Comparison) | 8 | 300 | 2.60 | 1.40 |
| 103 | 6 | 100 | 3.50 | 1.50 |
| (Invention) | 8 | 250 | 3.10 | 1.60 |

*Relative sensitivity herein refers to the relative value of sensitivity obtained for the sensitivity with respect to the reciprocal of an exposure to provide a density of the minimum density (stain) plus 1.0 in relation to the sensitivity of sample 101 when the first development-treated at a treating time of 6 min. was taken as 100.

**Gamma was represented by an inclination of straight line connecting a point of density of the minimum density plus 0.2 with a point of density of 2.0 on a characteristic curve.

TABLE 7

| Sample name | MTF value at frequency of 30 cycles/mm | | |
|---|---|---|---|
| | Yellow image | Magenta image | Cyan image |
| 101 (Comparison) | 0.90 | 0.70 | 0.50 |
| 102 (Comparison) | 0.93 | 0.75 | 0.65 |
| 103 (Invention) | 0.93 | 0.75 | 0.65 |

EXAMPLE 2

Samples 201 to 203 were prepared by the same process as in Example 1, except that compositions of the 10th layer and the 11th layer of Samples 101 to 103 were changed to compositions as set forth below, respectively. Emulsions A to F were used in Samples 201 to 203 according to an arrangement table for Emulsions A to F shown in Table 8. Herein, Sample 203 is an example according to the method of the present invention, and Samples 201 and 202 are comparative examples. In Example 2, internal latent image-type tabular silver halide emulsions of the present invention were used after being color sensitized.

The 10th layer: The 1st blue-sensitive emulsion layer

Gelatin layer (dry film thickness: 1.5 μm) containing the following:

| | |
|---|---|
| Silver iodobromide emulsion as in Table 8 spectrally sensitized with Sensitizing dye S-5 | 0.6 g/m² (as silver) |
| Coupler C-4 | 0.5 g/m² |
| High boiling point organic solvent $\overline{O}$-2 | 0.1 cc/m² |

The 11th layer: The 2nd blue-sensitive emulsion layer

Gelatin layer (dry film thickness: 3 μm) containing the following:

| | |
|---|---|
| Silver iodobromide emulsion as in Table 8 spectrally sensitized with Sensitizing dye S-6 | 1.1 g/m² (as silver) |
| Coupler C-4 | 1.2 gm/² |
| High boiling point organic solvent $\overline{O}$-2 | 0.23 cc/m² |

Structural formulae of Sensitizing dyes S-5 and S-6 are as follows.

S-5

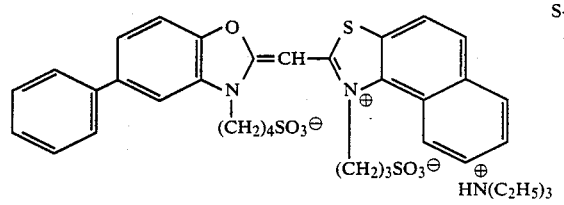

S-6

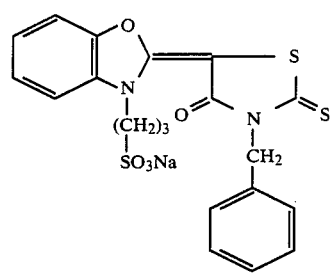

As in Example 1, wedge exposure and exposure for measurement of MTF were applied to Samples 201 to 203, and, after that, the same treatments as mentioned in Example 1 were applied to these exposed samples. Further, wedge-exposed samples were sensitization development-treated by extending the development time of the first development to 8 min. In Table 9 and in Table 10, results of sensitometry for Samples 201 to 203 and MTF values of those samples at a frequency of 30 cycles/mm are shown, respectively.

As shown in Table 9 and in Table 10, it is found that Sample 203 prepared according to the method of the present invention has high sharpness in each of cyan image, magenta image, and yellow image as compared with Sample 201 using non-tabular silver halide emulsion, and further has a high contrast for each of a cyan image, a magenta image, and a yellow image when sensitization development-treated, as compared with Sample 202 using surface latent image-type tabular silver halide emulsions.

TABLE 8

| Sample name | 3rd layer | 4th layer | 6th layer | 7th layer | 10th layer | 11th layer |
|---|---|---|---|---|---|---|
| 201 (Comparison) | B | A | B | A | B | A |
| 202 (Comparison) | D | C | D | C | D | C |
| 203 (Invention) | F | E | F | E | F | E |

TABLE 9

| Sample name | Development time of 1st Development | Yellow image Relative Sensitivity | Yellow image Density of unexposed part | Yellow image Gamma | Magenta image Relative Sensitivity | Magenta image Density of unexposed part | Magenta image Gamma | Cyan image Relative Sensitivity | Cyan image Density of unexposed part | Cyan image Gamma |
|---|---|---|---|---|---|---|---|---|---|---|
| 201 | 6 min | 100 | 3.6 | 1.55 | 100 | 3.6 | 1.60 | 100 | 3.2 | 1.50 |
| (Comparison) | 8 min | 180 | 3.2 | 1.65 | 175 | 3.2 | 1.70 | 175 | 3.0 | 1.60 |
| 202 | 6 min | 110 | 3.6 | 1.55 | 120 | 3.6 | 1.60 | 120 | 3.2 | 1.50 |
| (Comparison) | 8 min | 250 | 2.75 | 1.45 | 250 | 2.8 | 1.50 | 240 | 2.9 | 1.45 |
| 203 | 6 min | 130 | 3.6 | 1.55 | 150 | 3.6 | 1.60 | 150 | 3.2 | 1.50 |
| (Invention) | 8 min | 300 | 3.2 | 1.65 | 300 | 3.2 | 1.70 | 280 | 3.0 | 1.60 |

(Note 1) Relative sensitivity is represented by a relative value of sensitivity obtained when sensitivity is determined from a reciprocal of an exposure to provide a density of the minimum density plus 1.0 relative to the sensitivity of each of yellow, magenta, and cyan images of Sample 201 developed at a development time of 6 min being taken as 100.

(Note 2) The definition of gamma is the same as that in Table 6.

TABLE 10

| Sample name | MTF value at frequency of 30 cycles/mm Yellow image | Magenta image | Cyan image |
|---|---|---|---|
| 201 (Comparison) | 0.90 | 0.70 | 0.50 |
| 202 (Comparison) | 0.93 | 0.77 | 0.56 |
| 203 (Invention) | 0.93 | 0.77 | 0.56 |

EXAMPLE 3

Tabular silver halide grains G to J having pits comprising (211) face on the surface of grain were prepared as shown in Table 11. Solutions II to IV used herein were the same as those shown in Table 1.

Emulsion G (Surface Latent Image-Type Tabular Silver Halide Emulsion)

Solution III and Solution IV were added to Solution II by a double jet process in the first stage and in the second stage. Further, 40 mg of Compound (A) was added, and, after that, Solution III and Solution IV were added by a double jet process in the third stage. After the addition, the resulting emulsion was desalted and then chemically sensitized as in Emulsion C.

Structural formula of Compound (A)

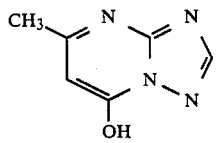

(A)

Emulsion H (Surface Latent Image-Type Tabular Silver Halide Emulsion)

Silver halide grains were formed by the same process as in Emulsion G except that the temperature of the reaction vessel was lowered and the addition speed of Solutions III and IV was increased in the second stage and in the third stage. The reaction of the third stage was carried out in the presence of compound (A). After completion of the above-mentioned reaction, the resulting emulsion was desalted and then chemically sensitized as in Emulsion D.

Emulsion I (Internal Latent Image-Type Tabular Silver Halide Emulsion)

The same process for forming silver halide grains as in Emulsion G was carried out in the first stage and in the second stage. After completion of the second stage, 3 mg of $Na_2S_2O_3$ and 1.8 mg of $KAuCl_4$ were added to the resulting emulsion and it was chemically sensitized at 70° C. for 50 min. Further, 40 mg of Compound (A) was added, and, after that, a part of Solution III and Solution IV were added to the emulsion by a double jet process in the third stage. After completion of the addition, the resulting emulsion was desalted as in Emulsion E.

Emulsion J (Internal Latent Image-Type Tabular Silver Halide Emulsion)

The same process for forming silver halide grains as in Emulsion H was carried out in the first stage and in the second stage. After completion of the second stage, 9 mg of $Na_2S_2O_3$ and 5.4 mg of $KAuCl_4$ were added to the resulting emulsion and it was chemically sensitized at 70° C. for 50 min. The reaction of the third stage was carried out in the presence of Compound (A) as in Emulsion H. After completion of the third stage, the resulting emulsion was desalted as in Emulsion F.

Emulsions G to J were all tabular silver iodobromide grains having a silver iodide content of 2.5 mol % and in the emulsion, 50% or more of the total projected area of grains was occupied by grains having an average aspect ratio of at least 5/1. Further, Emulsions G to J had pits comprising (211) face on the surface of grains and each of Emulsions G to J had about two times the specific surface area of an emulsion corresponding to it in Emulsions B to F. Herein, the specific surface area means the total surface area of a given amount of silver halide.

TABLE 11

| Emulsion designation | Temperature (°C.) | 1st stage Solution III (cc) | 1st stage Solution IV (cc) | 1st stage Addition time (sec) | 2nd stage Solution III (cc) | 2nd stage Solution IV (cc) | 2nd stage Addition time (min) | 3rd stage Solution III (cc) | 3rd stage Solution IV (cc) | 3rd stage Addition time (min) |
|---|---|---|---|---|---|---|---|---|---|---|
| G | 65 | 30 | 30.5 | 30 | 500 | 501 | 51 | 58 | 59 | 9 |
| H | 40 | " | " | " | " | " | 34 | " | " | 6 |
| I | 65 | " | " | " | " | " | 51 | " | " | 9 |
| J | 40 | " | " | " | " | " | 34 | " | " | 6 |

Samples prepared by applying each of Emulsions G to J to a substrate to have a silver coating weight of 2.0 g/m$^2$ was wedge-exposed with white light, and the exposed samples were developed with Developing Solution A and with Developing Solution C as in Example 1. The resulting images were tested for sensitometry, and, as a result, it was confirmed that Emulsions G and H were surface latent image-type emulsions and Emulsions I and J were internal latent image-type emulsions. Relative sensitivity of each of Emulsions G to J when developed with Developing Solution C to sensitivity of it when developed with Developing Solution A is shown in Table 12.

TABLE 12

| Emulsion name | Relative sensitivity of emulsion when developed with Developing Solution C to sensitivity thereof when developed with Developing Solution A* |
|---|---|
| G | 50 |
| H | 35 |
| I | 180 |
| J | 155 |

*Sensitivity was determined with respect to the reciprocal of an exposure to provide a density of fog plus 0.1.

Samples 301 and 302 were prepared by the same process as the preparing process for Samples 202 and 203, respectively, except that Emulsions G to J were used in the 3rd layer, 4th layer, 6th layer, 7th layer, 10th layer, and 11th layer according to an arrangement table for the emulsions shown in Table 13. Herein, Sample 302 is an example according to the method of the present invention and Sample 301 is a comparative example.

After Samples 301 and 302 were wedge-exposed as in Example 1, the exposed samples were treated by the same process as in Example 1. Two types of the first development treatments each having a developing time of 6 min. or 8 min. were carried out. Results of sensitometry for Samples 301 and 302 were shown in Table 14. As shown in Table 14, it is found that, in each of cyan, magenta, and yellow images, Sample 302 prepared by the method of the present invention has a high contrast when sensitization development-treated as compared with Sample 301 using surface latent image-type tabular silver halide grains when sensitization development-treated.

TABLE 13

| Sample name | 3rd layer | 4th layer | 6th layer | 7th layer | 10th layer | 11th layer |
|---|---|---|---|---|---|---|
| 301 (Comparison) | H | G | H | G | H | G |
| 302 (Invention) | J | I | J | I | J | I |

TABLE 14

| Sample name | Development time of 1st Development | Yellow image Relative Sensitivity | Yellow image Density of unexposed part | Yellow image Gamma | Magenta image Relative Sensitivity | Magenta image Density of unexposed part | Magenta image Gamma | Cyan image Relative Sensitivity | Cyan image Density of unexposed part | Cyan image Gamma |
|---|---|---|---|---|---|---|---|---|---|---|
| 301 | 6 min | 100 | 3.6 | 1.55 | 100 | 3.6 | 1.60 | 100 | 3.2 | 1.50 |
| (Comparison) | 8 min | 220 | 2.8 | 1.48 | 200 | 2.9 | 1.53 | 200 | 3.0 | 1.45 |
| 302 | 6 min | 130 | 3.6 | 1.55 | 130 | 3.6 | 1.60 | 130 | 3.2 | 1.50 |
| (Invention) | 8 min | 300 | 3.2 | 1.67 | 260 | 3.2 | 1.75 | 250 | 3.0 | 1.60 |

(Note 1) Relative sensitivity is represented by a relative value of sensitivity obtained when sensitivity is determined from a reciprocal of an exposure to provide a density of the minimum density plus 1.0 relative to the sensitivity of each of yellow, magenta, and cyan images of Sample 301 developed at a development time of 6 min being taken as 100.
(Note 2) The definition of gamma is the same as that in Table 6.

While the invention has been described in detail and with reference to specific embodiments thereof, it will be apparent to one skilled in the art that various changes and modifications can be made therein without departing from the spirit and scope thereof.

What is claimed is:

1. A silver halide color reversal photosensitive material comprising a plurality of silver halide emulsion layers on a substrate, wherein 50% or more of the total projected area of silver halide grains contained in at least one of said silver halide emulsion layers is occupied by tabular silver iodobromide grains having an average thickness of 0.5 micron or less, an average diameter of 0.5 micron or more, an average aspect ratio of at least 5/1, and a silver iodide content of 4.0 mol % or less, and said tabular silver iodobromide grains are negative-type silver halide grains forming a latent image mainly inside the grains.

2. A silver halide color reversal photosensitive material as in claim 1, wherein the diameter of the grains is from 0.5 to 3 microns, and the thickness of the grains is from 0.05 to 0.4 microns.

3. A silver halide color reversal photosensitive material as in claim 2, wherein the thickness of the grains is from 0.05 to 0.3 microns.

4. A silver halide color reversal photosensitive material as in claim 1, wherein the average aspect ratio of the grains is from 5/1 to 8/1.

5. A silver halide color reversal photosensitive material as in claim 2, wherein the average aspect ratio of the grains is from 5/1 to 8/1.

6. A silver halide color reversal photosensitive material as in claim 3, wherein the average aspect ratio of the grains is from 5/1 to 8/1.

7. A silver halide color reversal photosensitive material as in claim 1, wherein said tabular grains occupy 70% or more of the total projected area of silver halide grains contained in a least one of said silver halide emulsion layers.

8. A silver halide color reversal photosensitive material as in claim 2, wherein said tabular grains occupy 70% or more of the total projected area of silver halide grains contained in a least one of said silver halide emulsion layers.

9. A silver halide color reversal photosensitive material as in claim 3, wherein said tabular grains occupy 70% or more of the total projected area of silver halide grains contained in a least one of said silver halide emulsion layers.

10. A silver halide color reversal photosensitive material as in claim 4, wherein said tabular grains occupy 70% or more of the total projected area of silver halide grains contained in a least one of said silver halide emulsion layers.

11. A silver halide color reversal photosensitive material as in claim 5, wherein said tabular grains occupy 70% or more of the total projected area of silver halide grains contained in a least one of said silver halide emulsion layers.

12. A silver halide color reversal photosensitive material as in claim 6, wherein said tabular grains occupy 70% or more of the total projected area of silver halide grains contained in a least one of said silver halide emulsion layers.

13. A silver halide color reversal photosensitive material as in claim 1, wherein said tabular grains occupy 90% or more of the total projected area of silver halide grains contained in a least one of said silver halide emulsion layers.

14. A silver halide color reversal photosensitive material as in claim 2, wherein said tabular grains occupy 90% or more of the total projected area of silver halide grains contained in a least one of said silver halide emulsion layers.

15. A silver halide color reversal photosensitive material as in claim 3, wherein said tabular grains occupy 90% or more of the total projected area of silver halide grains contained in a least one of said silver halide emulsion layers.

16. A silver halide color reversal photosensitive material as in claim 4, wherein said tabular grains occupy 90% or more of the total projected area of silver halide grains contained in a least one of said silver halide emulsion layers.

17. A silver halide color reversal photosensitive material as in claim 5, wherein said tabular grains occupy 90% or more of the total projected area of silver halide grains contained in a least one of said silver halide emulsion layers.

18. A silver halide color reversal photosensitive material as in claim 6, wherein said tabular grains occupy 90% or more of the total projected area of silver halide grains contained in a least one of said silver halide emulsion layers.

19. A silver halide color reversal photosensitive material as in claim 1, wherein said latent image mainly inside the grains is such that when developed at a pH of 9.6 with a developing solution B, C, D, or E, as defined below, the sensitivity obtained with at least one of developing solutions B, C, D, or E is higher than the sensitivity obtained when developed with developing solution A:

| Developing Solution | Developing Solutions | | | | |
|---|---|---|---|---|---|
| Compounds | A | B | C | D | E |
| N—methyl-p-amino-phenol sulfate | 2.5 g | 2.5 g | 2.5 g | 2.5 g | 2.5 g |
| Sodium ascorbate | 10.0 g | 10.0 g | 10.0 g | 10.0 g | 10.0 g |
| Potassium metaborate | 35.0 g | 35.0 g | 35.0 g | 35.0 g | 35.0 g |
| Potassium bromide | 1.0 g | 1.0 g | 1.0 g | 1.0 g | 1.0 g |
| Sodium thiosulfate | none | 1.0 g | 2.0 g | 5.0 g | 10.0 g |
| Water to make | 1.0 l | 1.0 l | 1.0 l | 1.0 l | 1.0 l |

* * * * *